US008021286B2

(12) United States Patent
Suiter

(10) Patent No.: US 8,021,286 B2
(45) Date of Patent: Sep. 20, 2011

(54) EXERCISE APPARATUS WITH ADJUSTABLE RESISTANCE

(76) Inventor: William Gene Suiter, Campbell, CA (US)

( * ) Notice: Subject to any disclaimer, the term of this patent is extended or adjusted under 35 U.S.C. 154(b) by 71 days.

(21) Appl. No.: 12/053,330

(22) Filed: Mar. 21, 2008

(65) Prior Publication Data

US 2008/0248933 A1 Oct. 9, 2008

Related U.S. Application Data

(60) Provisional application No. 60/922,103, filed on Apr. 6, 2007.

(51) Int. Cl.
*A63B 21/02* (2006.01)

(52) U.S. Cl. ..... 482/122

(58) Field of Classification Search ..... 482/121–130, 482/148, 92, 139, 51, 93–96
See application file for complete search history.

(56) References Cited

U.S. PATENT DOCUMENTS 4,685,670 A 8/1987 Zinkin
5,222,927 A * 6/1993 Chang ..... 482/53
6,319,179 B1 11/2001 Hinds
2004/0166999 A1 8/2004 Dodge et al.
2005/0221965 A1 10/2005 Boland
2005/0266969 A1 12/2005 Karafa
2006/0128540 A1 * 6/2006 Engle ..... 482/123
2006/0160680 A1 7/2006 Ripley
2007/0054790 A1 3/2007 Dodge et al.

OTHER PUBLICATIONS

My body. my life. mygym. fitness system. https://www.buymygym.com/home, 1995.
My body. my life. mygym. fitness system. https://www.buymygym.com/pages/faqs---new, 1995.
Suzanne Somers ThighMaster Gold. http://www.asseenontv.com/prod-pages/thighmaster_gold.html, 1995.
Suzanne Somers Toning System. http://www.asseenontv.com/prod-pages/suzanne-somers-toning-sys..., 1995.

* cited by examiner

*Primary Examiner* — Lori Baker
(74) *Attorney, Agent, or Firm* — Stevens Law Group; David R. Stevens

(57) ABSTRACT

An exercise apparatus with adjustable resistance includes a housing and a cord mounting member coupled to the housing. An elastic cord is mounted to the cord mounting member and the cord mounting member permits movement of the elastic cord. A stop member is coupled to the elastic cord at a fixed location. An adjustable catch member is coupled to the housing and engages the stop member to limit movement of the elastic cord.

19 Claims, 7 Drawing Sheets

EXERCISE APPARATUS WITH ADJUSTABLE RESISTANCE

RELATED APPLICATIONS

This application claims priority based on U.S. provisional application No. 60/922,103, filed on Apr. 6, 2007, entitled "Exercise Apparatus with Adjustable Resistance."

BACKGROUND OF THE INVENTION

Exercise machine shave become apart of the modern every day routine. This phenomenon is evidenced in the demand today for fitness centers, at-home exercise and weight machines, and various other exercise-related products. Many of the available exercise machines are large, heavy, or otherwise not portable as a matter of practicality. Many people, however, find their exercise routine to be an essential part of their day, even when traveling for business or pleasure away from home. This can be seen as more and more commercial establishments are now offering fitness centers as part of the common amenities at hotels, cruises, and other lodging establishments.

Although relatively portable exercise devices such as the Thighmaster, see http://www.asseenontv.com/prod-pages/thighmaster_gold.html; http://www.asseenontv.com/prod-pages/suzanne-somers-toning-system.html!gid=, have been produced, they may not be ideal in either portability or versatility. The Thighmaster Gold, for example, is oddly shaped and would be awkward to pack into a suitcase. In addition, even in conjunction with it supper-body counterpart the Thighmaster LBX, the versatility of exercise motion available via the devices is limited Another device called the My Gym System, see https://www.buymygym.com/, was developed to expand the available exercises within a single apparatus. The My Gym allows for variable resistance through the use of various elastic bands, where one elastic band may offer a different resistance level from another elastic band. Thus, the design requires a number of elastic bands to provide the variable resistance, in addition to the number of elastic bands needed to provide for various exercise postures. This results in many elastic bands being included within the device compartment, and thus a relatively large exercise apparatus. Although the My Gym may be portable by hand its dimensions and weight are not nearly compact enough for purposes of light travel, for example, within a suitcase or travel bag.

Hence, it is desirable to have a solution, without the above-described disadvantages, such as an exercise apparatus with adjustable resistance, versatility of use, and ease of portability. As will be seen, the invention provides such a solution in an elegant manner.

BRIEF DESCRIPTION OF THE DRAWINGS

Throughout the description, similar reference numbers may be used to identify similar elements.

DETAILED DESCRIPTION

The invention is directed to an exercise apparatus with adjustable resistance. In particular, the invention is directed to an exercise apparatus with adjustable resistance, the exercise apparatus comprising a housing a cord mounting member coupled to the housing; an elastic cord mounted to the cord mounting member, wherein the mounting member permits movement of the elastic cord; a stop member coupled to the elastic cord at a fixed location; and an adjustable catch member coupled to the housing, the adjustable catch member to engage the stop member and limit the movement of the elastic cord.

Figure 1:
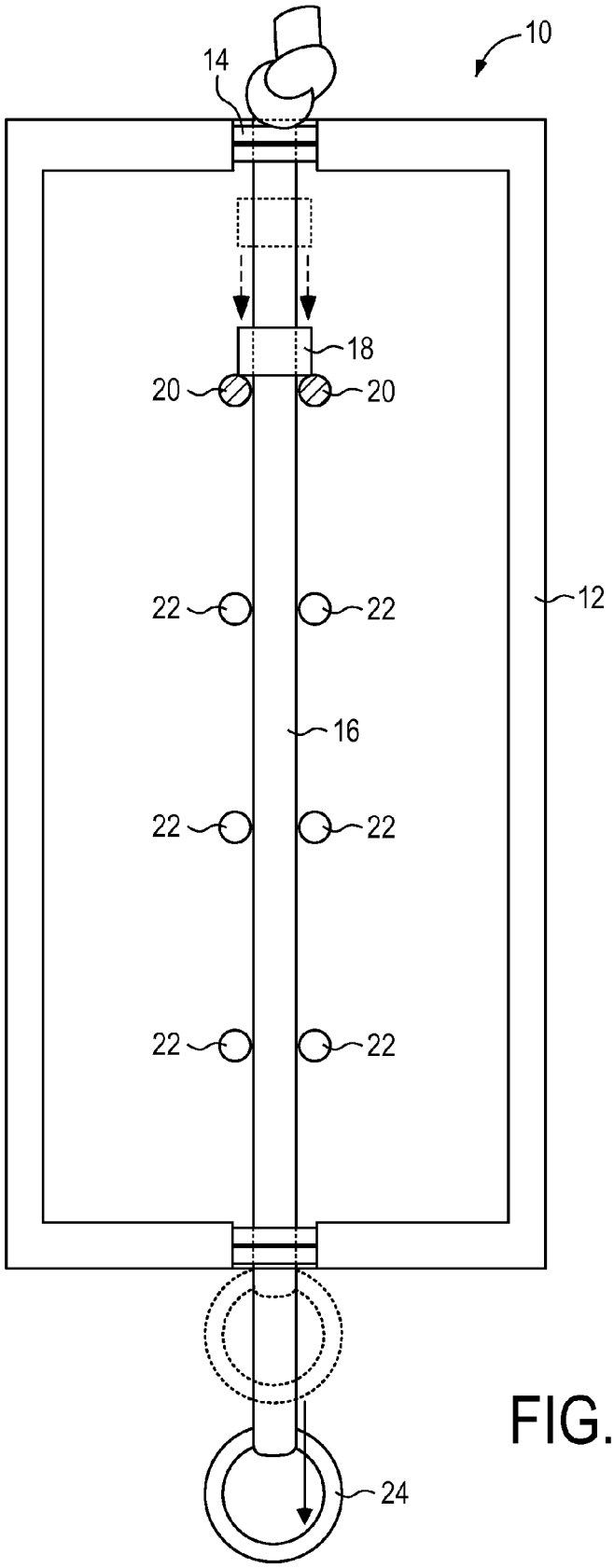
FIG. 1 depicts a schematic diagram of one embodiment of an exercise apparatus with adjustable resistance.

FIG. 1 depicts a schematic diagram of one embodiment of an exercise apparatus 10 with adjustable resistance. The illustrated exercise apparatus 10 includes a housing 12 with a cord mounting member 14. In one embodiment, the cord mounting member 14 may be an aperture in the housing through which an elastic cord 16 may be attached. Alternatively, the cord mounting member 14 may be a stanchion, a peg a pulley, or another structural member through or around which the elastic cord 16 may be mounted. It should be noted that the elastic cord 16 may be mounted to the cord mounting member 14 in a fixed (e.g., tied around a stanchion) or a movable (e.g, mounted to a pulley) manner. In another embodiment, there may be another cord mounting member 14 such as a pulley or a low friction material at about the location a here the opposite end of the cord 16 exits the housing 12. This cord mounting member 14 may reduce friction and wear on the cord 16 and/or the housing 12.

The elastic cord 16 may be any type of cord or other flexible material. Some exemplary materials include bungee cords, flexible rubber straps, or other types of elastic, flexible, or stretchy cords.

As top member 18 is attached to the elastic cord 16 at a fixed location so that, as the cord 16 is stretched, the stop member 18 maintains a position on the cord 16 relative to the length of the cord 16. Although some embodiments may use a knot in the cord 16 as a stop member 18, other embodiments implement a separate stop member 18. In one embodiment, the stop member 18 is crimped onto the cord 16, although other types of attachment mechanisms may be used. The stop member 18 may be made of any type of suitable material such as metal or plastic. In one embodiment, the stop member 18 is a plastic collar attached to the elastic cord 16.

As the elastic cord 16 is stretched in a longitudinal direction (i.e., along the length of the cord 16), the stop member 18 moves in the same direction with the cord 16. At one or more locations, an adjustable catch member 20 may be coupled to the housing 12 to impede the movement of the stop member 18 along the longitudinal path of the cord 16. As the adjustable catch member 20 engages the stop member 18, the movement of the stop member 18 is limited and hence, the elasticity of the cord 16 is altered from its disengaged state. For example, it may take more force to stretch the cord 16 when the stop member 18 is engaged by an adjustable catch member 20 because the length of the cord 16 is effectively decreased. Therefore, by adjusting the position of the adjustable stop member 20, the resistance of the cord 16 can be altered according to a user's preference.

In one embodiment, the exercise apparatus 10 includes a plurality of adjustable stop members 20 mounted in some of a plurality of corresponding holes. For example, the adjustable stop member 20 may be a pin or a bolt having a physical dimension and/or shape to match a hole in the base of the housing 12. By adjusting the location of the pin 20 in one or more holes 22 positioned along the length of the cord 16, the resistance of the cord 16 can be altered to several approximate resistance values.

As a matter of convention used through this description, the nearest adjustment position to the resting position of the stop member 18 is designated as the first position. The remaining adjustment positions are designated as the second, third, and fourth adjustment positions, and so on, as the adjustment positions increase in distance from the resting position of the stop member 18. However, this numbering convention is not intended to limit the arrangement, order, or number of adjustment positions or adjustable catch members 20 implemented in a particular embodiment.

As one example, a user may fix the adjustable pins 20 in the holes 22 at the first adjustment position as shown in FIG. 1. This configuration provides the most resistance for the user, for example, when the user attaches a handle to an attachment member 24 at the end of the cord 16 and pulls on the handle. For a less strenuous workout, the user may decrease the resistance of the exercise apparatus 10 by adjusting the position of the adjustable pins 20 in the holes 22 at the second adjustment position. In other words, as the pins 20 are moved to adjustment positions further away from the resting position of the stop member 18, the resistance of the cord 16 decreases.

In another embodiment, multiple stop members 18 may be attached to the cord 16 corresponding to each of the adjustment positions. For example, the exercise apparatus 10 may include four stop members 18 and four adjustment positions. In this embodiment, the first adjustment position provides the least resistance, and the last adjustment position provides the most resistance. Additionally, another structural member such as fixed stanchions or posts may be used to prevent the stop members 18 from traveling far enough to contact the cord mounting devices. Movement of the stop members 18 around such cord mounting devices may create noise, vibration, or possible derailment of the cord 16 from the cord mounting device.

In contrast, using a single stop member 18 reverses the resistance order of the adjustment positions—the first adjustment position provides the most resistance, and the last adjustment position provides the least resistance—because this configuration allows more travel distance and variation of resistance of the cord 16. As a comparison with the multiple stop member embodiment, the single stop member embodiment allows an increased travel distance of the cord 16 between the resting position and the last adjustment position. Additionally, the cord 16 in the single stop member embodiment may travel a greater distance before the stop member 18 might contact a cord mounting device such as a pulley or a stanchion and subsequently causing operational problems such as noise, vibration, or possible derailment of the cord 16 from the cord mounting device.

In one embodiment, the stop member 18 is prevented from traveling far enough to contact the cord mounting device such as a pulley. For example, the length of the reserve on the cord 16 may be insufficient for the cord 16 to be stretched far enough for the stop member 18 to reach the cord mounting device. The cord 16 may stretch enough to allow the stop member 18 to pass the last adjustment position, but not far enough to contact a cord mounting device. Alternatively, one or more structural members such as a stanchion or a pair of posts may prevent the stop member 18 from traveling far enough to contact the cord mounting devices. Such a structural member may, in effect, provide a fixed limit position which may be used as a final, non-adjustable, resistance setting.

In the single stop member embodiment, the movement of the stop member 18 around the cord mounting devices may be avoided. Since the travel distance of a single stop member 18 may be greater than the travel distance of a stop member 18 in the multiple stop member embodiment, the elasticity of the cord 16 accommodates a travel distance of the stop member 18 from its resting position to at least the last adjustment position. Additionally, in this embodiment, the cord 18 may be implemented with a pretensioned elasticity which may affect the functionality of the stop member 18, as well as the attachment member 24. For example, the pretensioned elasticity of the cord 16 may facilitate retraction of the stop member 18 to approximately its resting position. Otherwise, without such pretensioning, the resting position of the stop member 18 may change over time. Furthermore, the pretensioned elasticity of the cord 16 may retain the attachment member 24, for example, snugly against the housing 12 while the exercise apparatus 10 is not in use. Moreover, the pretensioned elasticity of the cord 16 may facilitate these positions even after some elasticity loss from prolonged usage of the exercise apparatus 10.

Additionally, it should also be noted that the exercise apparatus 10 may be used in a configuration where the stop member 18 does not engage any adjustment catch members 20. For example, the pins 20 may be removed from the holes 22 or from the exercise apparatus altogether. In this configuration, the resistance of the cord 16 is less than if the stop member 18 were to engage one of the pins 20 because the full length of the cord 16 is available to be stretched as the user pulls the attachment member 24 away from it's resting position (shown dashed), as indicated by the arrow.

It should also be noted that, although the depicted exercise apparatus 10 includes two sets of holes 22 and adjustable pins 20—one on each side of the cord 16—other embodiments may include a singe set of holes 22 and a single adjustable pin 20 on just one side of the cord 16. In this embodiment, it may be useful to include a barrier 34 (see FIG. 2) on the opposite side of the cord 16 or to locate the cord 16 within a channel (not shown).

The embodiments disclosed herein may allow for not only adjustability of resistance, and versatility of use with various exercise motions and postures, but also light and compact portability, for example, inside a suitcase or travel bag. Given the variable resistance levels that may be rendered on single elastic cord via the embodiments described above, multiple cords each of a different elasticity may not be required. Hence, a single or small number of elastic cards may be required altogether, and thus a relatively compact compartment maybe able to house the cords and other parts of the apparatus. This results in an exercise apparatus that may be of small dimensions and low weight.

Figure 2:
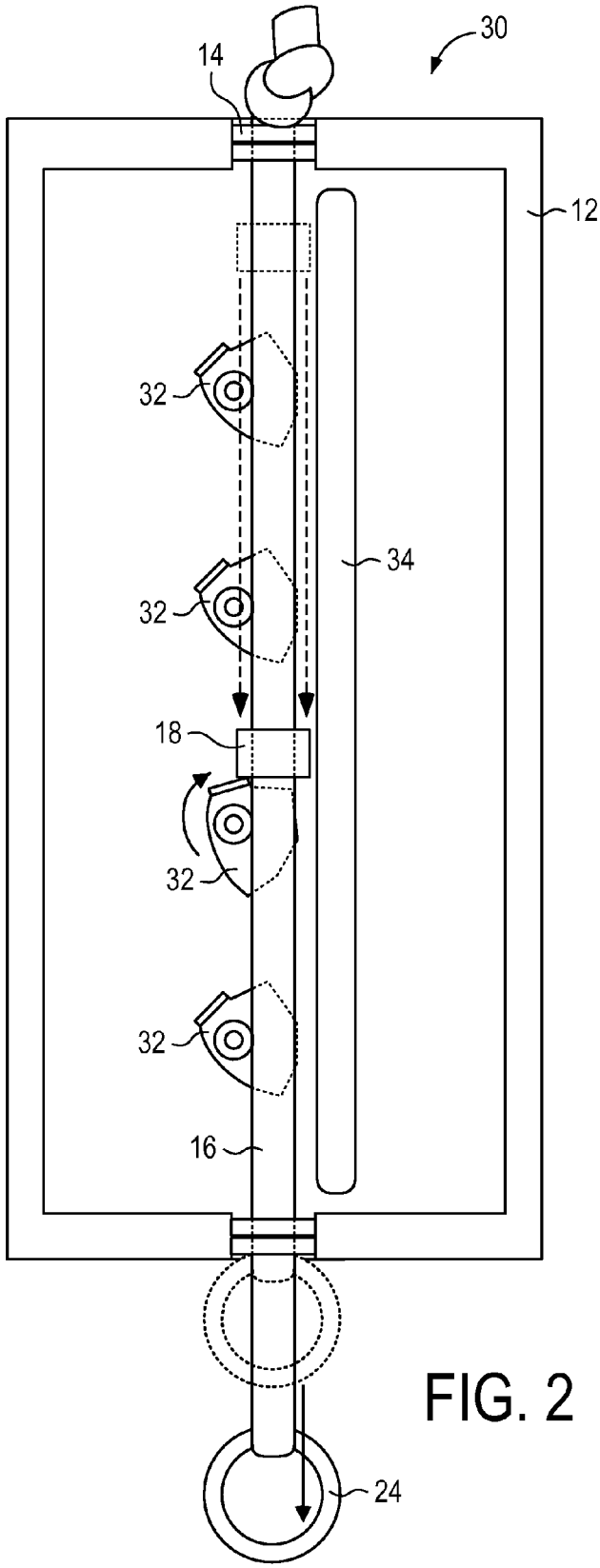
FIG. 2 depicts a schematic diagram of another embodiment of an exercise apparatus with adjustable resistance.
Figure 3:
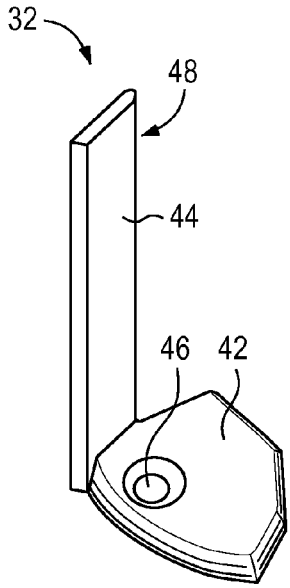
FIG. 3 depicts a schematic diagram of one embodiment of a cam for use in the exercise apparatus of FIG. 2.

FIG. 2 depicts a schematic diagram of another embodiment of an exercise apparatus 30 with adjustable resistance. Many components of the exercise apparatus 30 shown in FIG. 2 are substantially similar to the components of the exercise apparatus 10 shown in FIG. 1 and described above. However, instead of using adjustable pins 20 to engage the stop member 18, the exercise apparatus 30 shown in FIG. 2 uses one or more cams 32. A more detailed embodiment of a cam 32 is shown in FIG. 3. Each cam 32 can be rotated into or out of the path of the stop member 18. For example the third cam 32 (i.e., the cam 32 in the third adjustment position away from the resting position of the stop member 18) is shown rotated in an engaged position to engage the stop member 18 and impede further movement of the stop member 18 in the direction of the attachment member 24.

In order to counter balance any lateral (i.e., sideways) movement of the cord 16 away from the cams 32 when a cam 32 engages the stop member 18, the exercise apparatus 30 includes a barrier 34. Although the barrier is shown along the length of the cord 16, other embodiments of the exercise apparatus 30 may include multiple barriers 34 selectively located at each individual cam location 32. In some embodiments, some or all of the barrier 34 (or multiple barriers) are also used to provide structural support between a base and a cover of the housing 12. In another embodiment, the cord 16 may be located in a channel (not shown) or may be otherwise constrained within the housing 12.

FIG. 3 depicts a schematic diagram of one embodiment of a cam 32 for use in the exercise apparatus 30 of FIG. 2. The cam 32 includes a base member 42, a vertical member 44, and a pivot point 46. In one embodiment, the pivot point 46 is an aperture for a screw or other fastener to rotatably couple the cam 32 to the housing 12 or another structural member of the exercise apparatus 30. Embodiments of the cam 32 may be made of metal, plastic, or another type of material.

In one embodiment, one or more edges of the cam 32 may be beveled. In some embodiments, a beveled edge on the vertical member 44 enhances engagement of the stop member 18 with the cam 32. For example, the vertical edge 48 of the vertical member 44 may be beveled to approximately match the angle of the adjacent edge on the base member 42 of the cam 32. In this way, the stop member 18 may substantially engage with both the beveled vertical edge 48 and the adjacent edge of the base member 42 at the sametime, in a relatively "flat" manner. Without a bevel on the vertical edge 48 of the vertical member 44, the vertical edge 48 may dig into the stop member, depending on the relative hardness of the vertical member 44 and the stop member 18. However, some embodiments nevertheless may implement the cam 32 without a bevel on the vertical edge 48 of the vertical member 44.

In other embodiments, a bevel on one or more edges on the base member 42 reduces the chance of accidental engagement of the stop member 18 with the cam 32. While the base edge adjacent to the vertical edge 48 of the vertical member 44 may be used to engage the stop member 18, some embodiments may include bevels on the other edges of the base member 44 so that the stop member 18 is able to slide past the beveled edges and not catch when the cam 32 is in the disengaged, or open, position.

As an alternative to using bevels on the edges of the base member 42 of the cam 32, some embodiments of the exercise apparatus 30 may recess the base member 42 of the cam 32 into the housing 12 so that the top of the base member 42 is approximately flush with the interior surface of the housing 12. In this configuration, the stop member 18 travels on or above the interior surface of the housing 12 and hence, over the base member 42 of the cam 32 so that the stop member 18 does not accidentally engage an edge of the recessed base member 42 of the cam 32.

Figure 4:
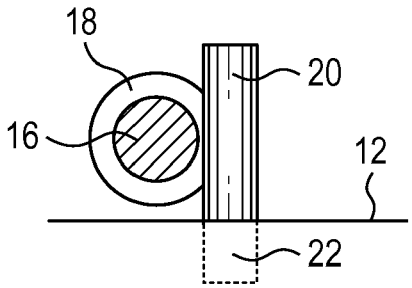
FIG. 4 depicts a cross-sectional diagram of one embodiment of an adjustment assembly implemented with an adjustable pin.

FIG. 4 depicts a cross-sectional diagram of one embodiment of an adjustment assembly implemented with an adjustable pin 20. In particular, the adjustment assembly illustrates the adjustable pin 20 engaging the stop member 18 coupled to the cord 26. In one embodiment, the adjustable pin is inserted in a hole 22 in the housing 12. As explained above, the resistance of the cord 16 may be adjusted by moving the pin 20 from one hole 22 to another hole 22 along the length of the cord 16. Other embodiments using adjustable pins 20 may include another pin 20 or a barrier 34 on the opposite side of the cord 16.

Figure 5A:
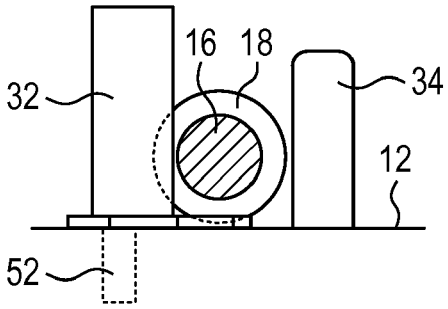
FIG. 5A depicts a cross-sectional diagram of another embodiment of an adjustment assembly implemented with an adjustable cam.

FIG. 5A depicts a cross-sectional diagram of another embodiment of an adjustment assembly implemented with an adjustable cam 32. The cam 32 may be attached to the housing 12, for example, by a fastener 52 recessed into the housing 12. In the depicted embodiment, the base member 42 of the cam 32 is not recessed into the interior surface of the housing 12. This allows an edge of the base member 42, as well as the vertical edge 48 of the vertical member 44 to engage the stop member 18. In one embodiment, a barrier 34 is coupled to the housing 12 opposite the cam 32, as described above.

Figure 5B:
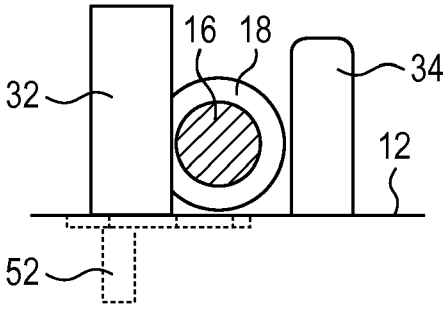
FIG. 5B depicts a cross-sectional diagram of another embodiment of an adjustment assembly implemented with a cam in which the base member of the cam is recessed into the housing.

FIG. 5B depicts a cross-sectional diagram of another embodiment of an adjustment assembly implemented with an adjustable cam 32 in which the base member 42 of the cam 32 is recessed into the housing 12. As described above, recessing the base member 42 of the cam 32 into the housing 12 may eliminate the risk of the stop member 18 accidentally catching on the base member 42 when the cam 32 is in the disengaged, or open, position. As a result, the vertical member 44 of the cam 32 would receive more pressure from the stop member 18 in the engaged position, instead of distributing the force of the stop member 18 between the vertical member 44 and the base member 42 of the cam 32. In one embodiment, the vertical member 44 is mad of a thicker or otherwise stronger material to with stand the additional stress. Additionally, the cam 32 may be mounted to the housing 12 a slight angle away from the path of the stop member 18, instead of being aligned at a right angle to the path of the stop member 18. This configuration allows the force of the stop member 18 to travel somewhat through the width, instead of through the depth of the vertical member 44, effectively making the vertical member 44 stronger similar to using a thicker material. Also, the angle may provide added grip to engage the cam 32 with the stop member 18.

Figure 6:
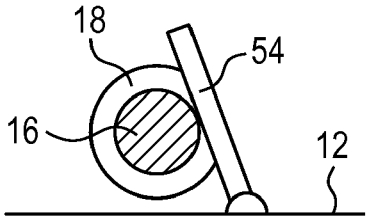
FIG. 6 depicts a cross-sectional diagram of another embodiment of an adjustment assembly implemented with an adjustable lever.

FIG. 6 depicts a cross-sectional diagram of another embodiment of an adjustment assembly implemented with an adjustable lever 54. In one embodiment, the adjustable lever 54 is mounted to a pivot point at the interior surface of the housing 12. Alternatively, the pivot point of the lever 54 may be on another structural member such as a barrier 34. In another embodiment, a barrier 34 may be positioned opposite the lever 54, similar to the embodiment described above.

Other embodiments of the exercise apparatus 10 may implement other types of adjustable catch members.

Figure 7A:
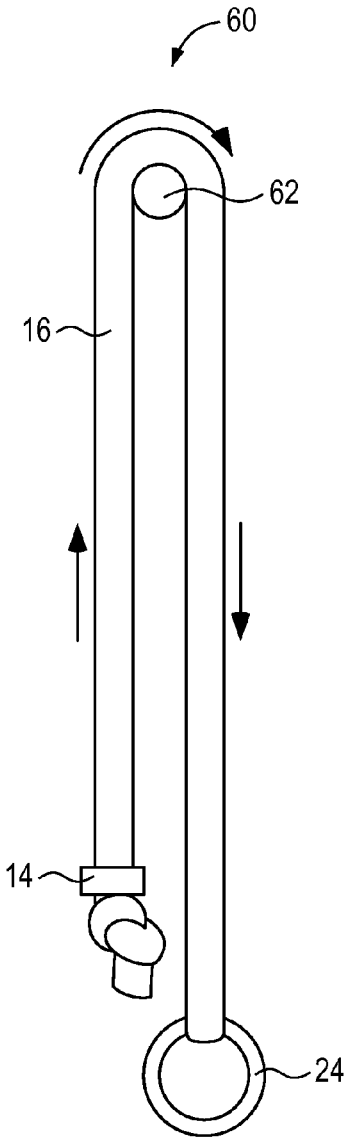
FIG. 7A depicts a schematic diagram of one embodiment of a pulley system with a single pulley for use with the exercise apparatus of FIG. 1 or the exercise apparatus of FIG. 2.

FIG. 7A depicts a schematic diagram of one embodiment of a pulley system 60 with single pulley 62 for use with the exercise apparatus 10 of FIG. 1 or the exercise apparatus 30 of FIG. 2. In one embodiment, the pulley 62 is a ball-bearing, grooved pulley. Alternatively, a stanchion or post may be used in place of the pulley 62. Other embodiments may use another type of pulley 62. Additionally, the pulley 62 may be fixed or movable, depending on the implementation of the exercise apparatus 10.

Figure 7B:
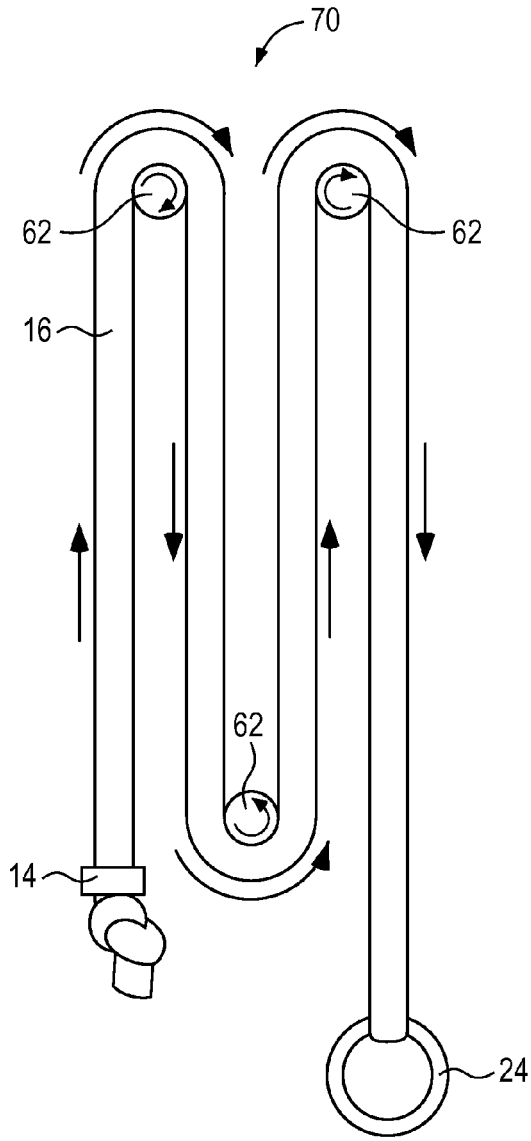
FIG. 7B depicts a schematic diagram of another embodiment of a pulley system with multiple pulleys for use with the exercise apparatus of FIG. 1 or the exercise apparatus of FIG. 2.
Figure 7C:
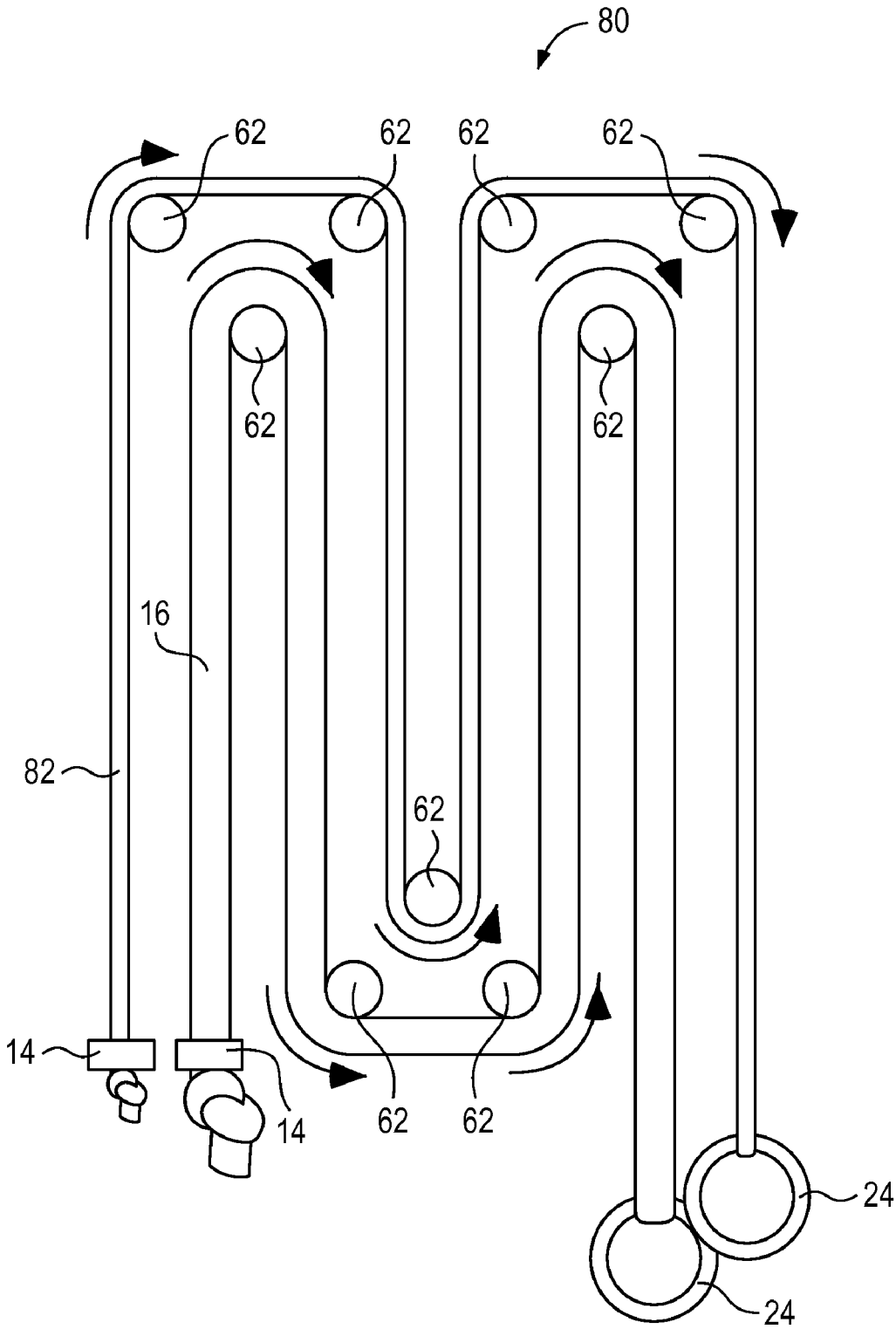
FIG. 7C depicts a schematic diagram of one embodiment of a pulley system with multiple sets of pulleys for multiple cords for use with the exercise apparatus of FIG. 1 or the exercise apparatus of FIG. 2.

FIG. 7B depicts a schematic diagram of another embodiment of a pulley system 70 with multiple pulleys 62 for use with the exercise apparatus 10 of FIG. 1 or the exercise apparatus 30 of FIG. 2. One reason for using multiple pulleys 62, as opposed to a single pulley 62, in the exercise apparatus 10 is to decrease the resistance of the cord 16 by providing a longer length of the cord 16 to distribute the resistance. In addition to the alternative pulley configurations described above, some or all of the pulleys 62 may be arranged as a compound pulley or another combination of fixed and/or moveable pulleys FIG. 7C depicts a schematic diagram of one embodiment of a pulley system 80 with multiple sets of pulleys 62 for multiple cords 16 and 82 for use with the exercise apparatus 10 of FIG. 1 or the exercise apparatus 30 of FIG. 2. In one embodiment, the cords 16 and 82 may have different lengths, widths, or flexibility characteristics. Additionally, a single adjustable catch member 20 may be used to engage the stop members 18 (not shown in FIG. 7C) for both of the cords 16 and 82. Alternatively, each cord 16m ay have a corresponding adjustable catch member 20 that may be adjusted independently of one another, so that the cords 16 and 82 may be pulled together at a variety of resistances depending on the settings of each of the adjustable catch members 20.

Figure 8A:
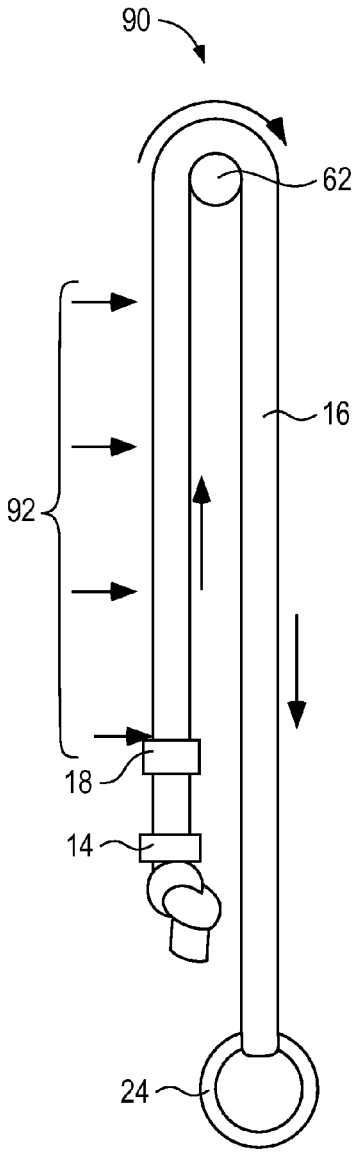
FIGS. 8A-C depict schematic diagrams of different embodiments of a stopping mechanism for use with the exercise apparatus of FIG. 1 or the exercise apparatus of FIG. 2, with the stop member engaged by different adjustable catch members of the stopping mechanism.
Figure 8B:
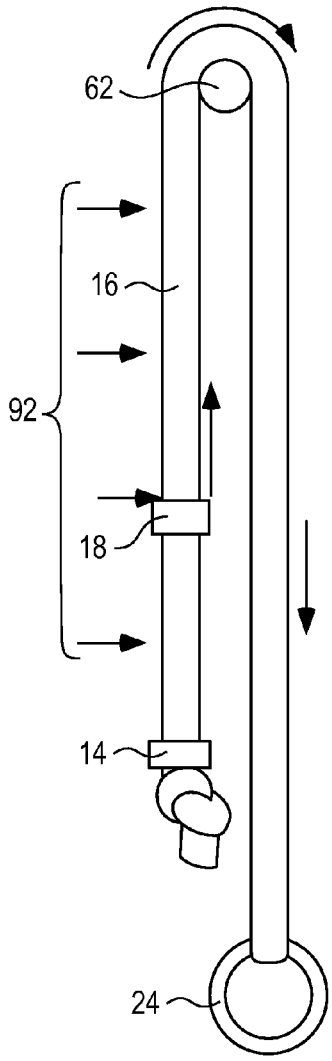
Figure 8C:
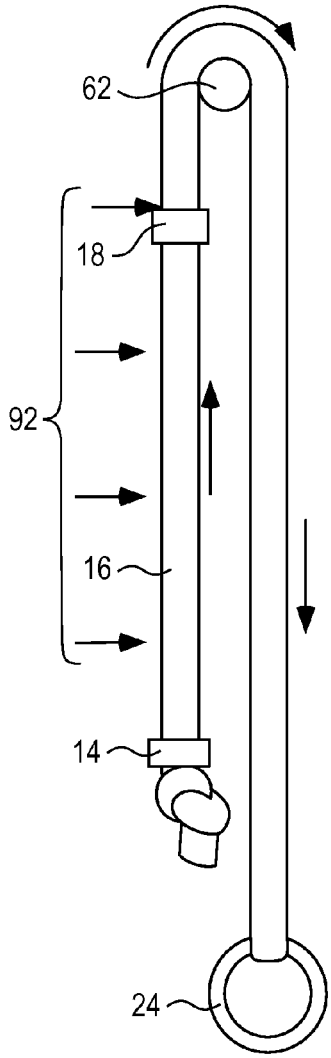

FIGS. 8A-C depict schematic diagrams of different embodiments of a stopping mechanism 90 for use with the exercise apparatus of FIG. 1 or the exercise apparatus 30 of FIG. 2, with the stop member 18 engaged by different adjustable catch members 92 of the stopping mechanism 90. In particular, FIG. 8A shows the stop member 18 engaged by the first adjustable catch member 92 (closest to the resting position of the stop member 18). FIG. 8B shows the stop member 18 engaged by the second adjustable catch member 92. Similarly, FIG. 8C shows the stop member 18 engaged by the last adjustable catch member 92.

It should be noted that the illustrated arrows are representative of various types of adjustable catch members 92, including pins 20, cams 32, levers 54, and so forth. Depending on the implementation of the exercise apparatus 10, some embodiments of the adjustable catch members 92 include a single adjustable catch member 92 that may be moved among multiple adjustment positions, while other embodiments include multiple adjustable catch members 92 distributed at the corresponding adjustment locations.

Figure 9:
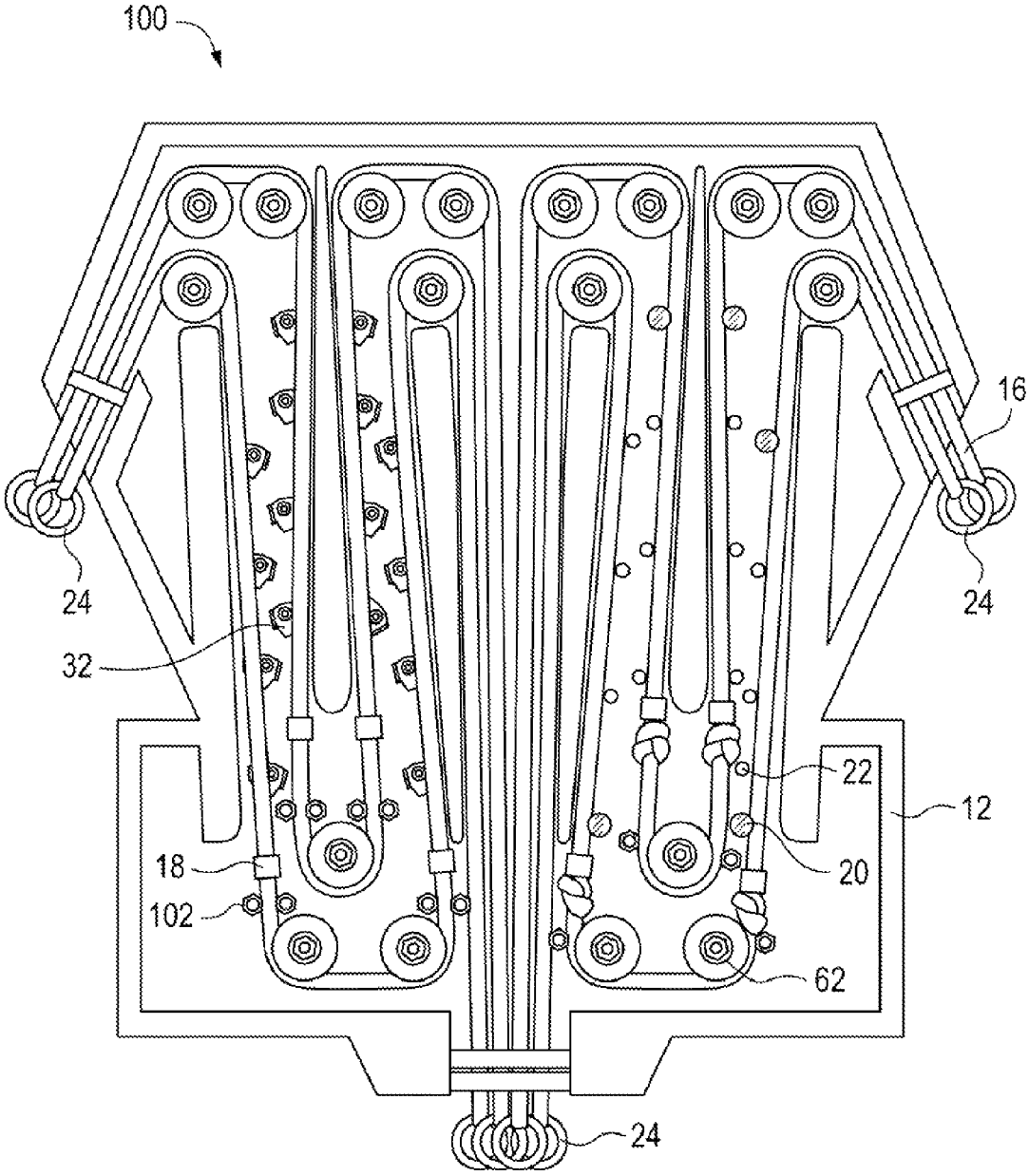
FIG. 9 depicts a schematic diagram of one embodiment of a multifunctional exercise apparatus.

FIG. 9 depicts a schematic diagram of one embodiment of a multifunctional exercise apparatus 100. In particular, the illustrated multifunctional exercise apparatus 100 includes four elastic cords 16 mounted to various pulleys 62. Each cord 16 has two stop members 18 since each cord 16 may be pulled by a user from either end. In other words, one stop member 18 for a given cord 16 facilitates limiting the movement of the cord 16 in one longitudinal direction, and the other stop member 18 for the same cord limits the movement of the cord 16 in the opposite longitudinal direction. The multifunctional exercise apparatus 100 also includes one or more corresponding adjustable catch mechanisms 92, for example, in the form of pins 20, cams 32, or bolts 102, for each of the stop members 18. Although the cords 16 and pulleys 62 of the multifunctional exercise apparatus 100 are arranged in a particular layout, other embodiments of the multifunctional exercise apparatus 100 may have other arrangements for the various components It should be noted that embodiments of the multifunctional exercise apparatus 100 may be used for various exercises and activities. Hence, embodiments of the multifunctional exercise apparatus 100 may have different shapes, sizes, components, and configurations. Some exemplary alternative embodiments include the following: a pad coupled to the housing 12 so that a user can sit, lay or kneel on the apparatus 100; a bladder (e.g., similar to a portion of an exercise ball) coupled to the housing 12 (e.g., on the top or on the bottom) to facilitate core stability exercises using the apparatus 100; a hinged foldable, or otherwise collapsible housing 12 to facilitate easy transportation and travel with the apparatus 100; mounting hardware to facilitate mounting the apparatus 100 to a wall, a chair, a bench, or other exercise equipment; mechanical or electromechanical controls (i.e., an adjustment member) to control the movement of the adjustable catch members 92; electronics within the housing to facilitate guided workouts, gather historical data (e.g., counting reps and/or sets), provide audible or visual feedback, or implement timer or counter; integrated handles, stirrups, or other contact grips in place of the attachment members 24; and coves within the perimeter of the housing 12 to allow the attachment members 24 to recess within the footprint of the hosing 12. Moreover, other embodiments of the multifunctional exercise apparatus 100 may implement various other components, features, or arrangements.

Although specific embodiments of the invention have been described and illustrated the invention is not to be limited to the specific forms or arrangements of parts so described and illustrated. The scope of the invention is to be defined by the claims appended hereto and their equivalents.

What is claimed is:

1. An exercise apparatus with adjustable resistance, the exercise apparatus comprising:

a housing;

a cord mounting member coupled to the housing;

an elastic cord mounted to the cord mounting member, wherein the cord mounting member permits movement of the elastic cord;

a stop member coupled to the elastic cord at a fixed location; and an adjustable catch member coupled to the housing and configured , the adjustable catch member to engage the stop member to and limit the movement of the elastic cord, wherein the resistance of the exercise apparatus changes when the adjustable catch member engages the stop member.

2. The exercise apparatus of claim 1, wherein the stop member comprises a plastic collar.

3. The exercise apparatus of claim 1, wherein the stop member is configured to engage the adjustable catch member in response to longitudinal movement of the elastic cord, wherein the adjustable catch member is configured to stop the longitudinal motion of a portion of the elastic cord at the adjustable catch member.

4. The exercise apparatus of claim 3, wherein the adjustable catch member comprises a pin configured to engage a hole of a plurality of holes in the housing to hold the pin in a fixed location relative to the elastic cord, wherein the plurality of holes are spaced along a length of the elastic cord.

5. The exercise apparatus of claim 3, wherein the adjustable catch member comprises a cam rotatably coupled to the housing, wherein the cam comprises a flange member configured to rotate into a longitudinal path of movement of the stop member to engage the stop member.

6. The exercise apparatus of claim 5, further comprising a plurality of additional cams rotatably coupled to the housing, wherein the additional cams are spaced along a length of the elastic cord.

7. The exercise apparatus of claim 5, wherein the flange of the cam comprises an edge to engage the elastic cord as the flange engages the stop member.

8. The exercise apparatus of claim 7, wherein the edge of the flange is beveled.

9. The exercise apparatus of claim 3, wherein the adjustable catch member comprises a lever mounted to the housing, wherein a portion of the lever is configured to engage the stop member in an engaged position.

10. The exercise apparatus of claim 1, further comprising a handle coupled to an end of the elastic cord, wherein the elastic cord extends out of the housing to the handle.

11. The exercise apparatus of claim 1, wherein the cord mounting member comprises a pulley.

12. The exercise apparatus of claim 1, wherein housing comprises a cover and a base to enclose the elastic cord, the stop member, and at least a portion of the adjustable catch member within the housing.

13. The exercise apparatus of claim 12, further comprising an adjustment member coupled to the adjustable catch member, wherein the adjustment member is operable by physical contact outside the housing to move the adjustable catch member between an engaged position and a disengaged position.

14. The exercise apparatus of claim 13, wherein the adjustment member is further operable to move the adjustable catch member between first and second catch positions.

15. The exercise apparatus of claim 12, further comprising a pad coupled to an outside surface of the housing.

16. The exercise apparatus of claim 15, wherein the pad is removable from the outside surface of the housing.

17. The exercise apparatus of claim 1, wherein the housing further comprises a joint to couple together first and second portions of the housing, wherein the housing is configured to be folded at the joint.

18. An exercise apparatus with adjustable resistance, the exercise apparatus comprising:

a housing;

a plurality of cord mounting members coupled to the housing;

an elastic cord mounted to each of the plurality of cord mounting members, wherein at least one of the plurality of cord mounting members permits movement of the elastic cord;

a stop member coupled to the elastic cord at a fixed location; and an adjustable catch member coupled to the housing, the adjustable catch member to engage the stop member and limit the movement of the elastic cord, wherein the resistance of the exercise apparatus changes when the adjustable catch member engages the stop member.

19. The exercise apparatus of claim 18, wherein the plurality of cord mounting members are disposed such that the elastic cord is mounted in a nonlinear configuration.

* * * * *